US006884013B2

(12) United States Patent
Kiviranta et al.

(10) Patent No.: US 6,884,013 B2
(45) Date of Patent: Apr. 26, 2005

(54) MOUNTING AND DISMOUNTING MECHANISM FOR A STRAIGHTENING OR CALIBRATING ROLLER ROTATABLE ABOUT A SPINDLE AND PROVIDED WITH A CIRCULAR GROOVE

(75) Inventors: Risto Kiviranta, Vähäkyrö (FI); Pertti Lehto, Laihia (FI)

(73) Assignee: T-Drill Oy, Laihia (FI)

( * ) Notice: Subject to any disclaimer, the term of this patent is extended or adjusted under 35 U.S.C. 154(b) by 0 days.

(21) Appl. No.: 09/991,491

(22) Filed: Nov. 21, 2001

(65) Prior Publication Data

US 2002/0092726 A1 Jul. 18, 2002

(30) Foreign Application Priority Data

Nov. 24, 2000 (FI) ..... 20002582

(51) Int. Cl.[7] ..... F16B 21/00
(52) U.S. Cl. ..... 411/348; 411/351; 403/322.2
(58) Field of Search ..... 411/348, 347, 411/351; 24/453; 403/321, 322.1–322.4, 315–317; 384/547

(56) References Cited

U.S. PATENT DOCUMENTS 1,975,296 A * 10/1934 Ross ..... 384/547
3,097,898 A * 7/1963 Ferdig ..... 384/547
3,498,099 A 3/1970 Thompson
3,858,280 A * 1/1975 Martens ..... 70/57.1
4,321,815 A 3/1982 Ecker et al.
4,655,657 A * 4/1987 Duran ..... 411/348
5,692,851 A * 12/1997 Pace ..... 403/31
6,331,091 B2 * 12/2001 Cross ..... 403/322.2
6,390,680 B1 * 5/2002 Last ..... 384/55

FOREIGN PATENT DOCUMENTS

EP 401097 A1 * 12/1990 ..... F16B/21/16
JP 06264921 A * 9/1994 ..... F16C/13/02

* cited by examiner

*Primary Examiner*—William L. Miller
(74) *Attorney, Agent, or Firm*—Klauber & Jackson

(57) ABSTRACT

The invention relates to a mounting and dismounting mechanism for a straightening or calibrating roller (2) rotatable about a spindle (1) and provided with a circular groove (13). The spindle (1) has its cavity (4) fitted with a pusher (9), having a tapered thrust face (9*a*, 9*b*) which shifts, as a result of the force of a spring (10), a holder element (8) from its release position to its clamping position. The holder element (8) is located in an opening present in a wall (3) of the cylinder (4). A plunger (11), associated with the pusher (9), can be used for moving the pusher against the force of the spring (10) to a position in which the holder element (8) is capable of shifting from its clamping position to its release position in which the roller is removable from the spindle (1) or mountable onto the spindle.

10 Claims, 2 Drawing Sheets

MOUNTING AND DISMOUNTING MECHANISM FOR A STRAIGHTENING OR CALIBRATING ROLLER ROTATABLE ABOUT A SPINDLE AND PROVIDED WITH A CIRCULAR GROOVE

BACKGROUND OF THE INVENTION

The invention relates to a mounting and dismounting mechanism for a straightening or calibrating roller rotatable about a spindle and provided with a circular groove, comprising at least one holder element, the roller being adapted to be mountable and clampable by means of the holder element around the spindle, and to be dismountable and removable from around the spindle co-directionally with a longitudinal axis of the spindle.

The invention is applied in the process of straightening or calibrating a pipe, a shaft, or a wire, which involves a relatively large number of straightening or calibrating rollers for advancing a metal pipe or shaft therethrough. As the diameter of a pipe or a shaft changes, the straightening or calibrating mechanism must be refitted with rollers provided with a respectively dimensioned circular groove. The prior known mounting and dismounting mechanisms employ a nut or wedge attachment, the replacement of a roller requiring a tool. Since there are a large number of rollers to be replaced, the replacement of rollers is a tedious and awkward process.

It is an object of the invention to provide an improved mounting and dismounting mechanism, which enables a quick replacement of a roller by a single-handed grip without a tool.

Another benefit gained by the invention is e.g. the fact that no components of the mounting mechanism has to be removed from the spindle or the mechanism.

BRIEF DESCRIPTION OF THE DRAWINGS

One exemplary embodiment of the invention will now be described more closely in two different applications with reference made to the accompanying drawing, in which.

DETAILED DESCRIPTION OF THE INVENTION

Figure 1:
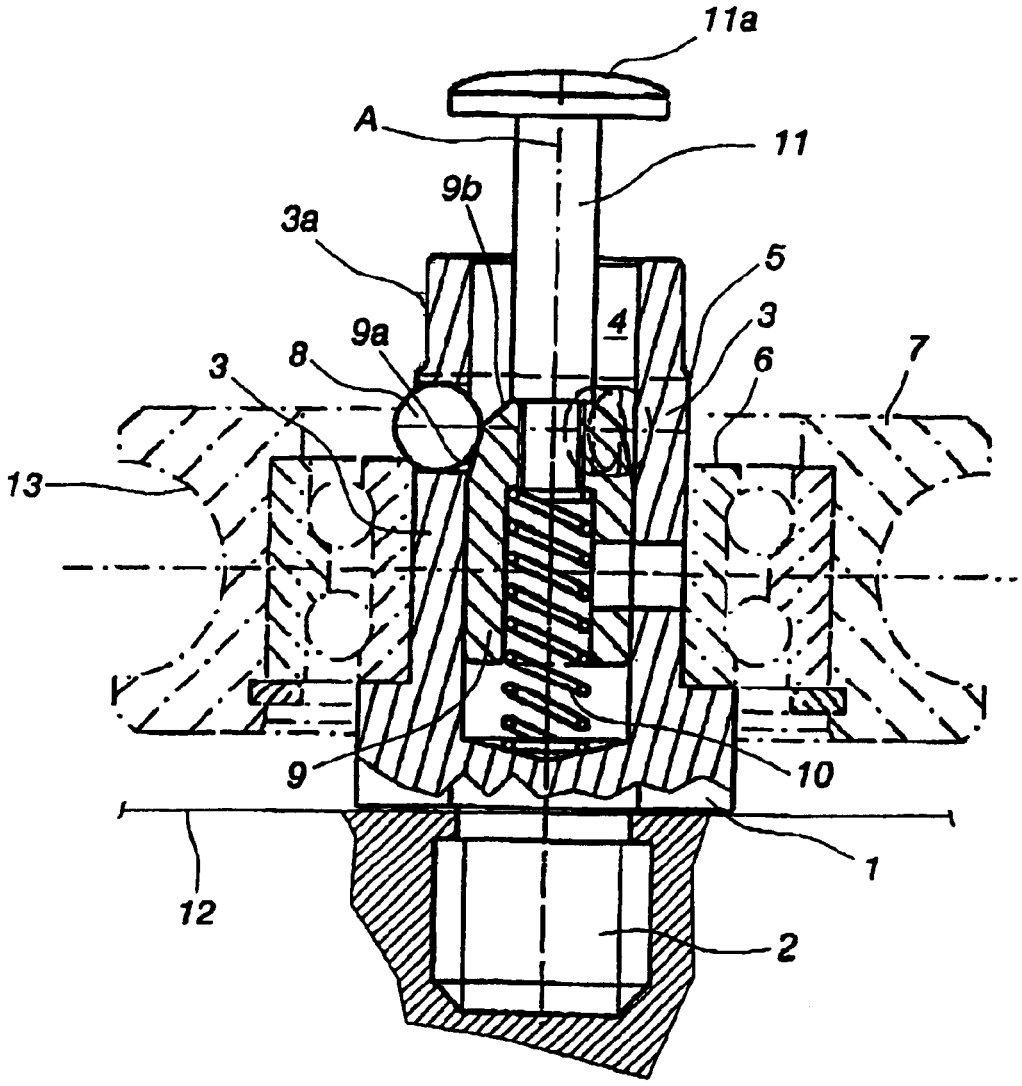
FIG. 1 shows in an axial section a mounting and dismounting mechanism of the invention for a straightening or calibrating roller in an application, which comprises a bearing-fitted roller mounted on a stationary spindle.

A straightening or calibrating roller 7 is provided with a circular groove 13, having a radius of curvature which is adapted to comply with that of the outer periphery of a pipe or a shaft to be straightened. The circular groove may also comprise a V-groove intended for straightening smaller diameter rods or metal wires, in which case a single groove is adaptable to a limited range of diameters. In the case of FIG. 1, the roller 7 is provided with a bearing 6, which is adapted to be mounted about a spindle 1 and to be clamped in position by means of holder elements 8 which may be balls, as shown. In a release position of the holder elements 8, which will be described more closely hereinbelow, the bearing 6, along with its roller 7, is releasable and removable from around the spindle 1 co-directionally with a longitudinal axis A of the spindle 1.

The spindle 1 is formed with a cylindrical cavity 4, having its wall provided with three openings at a 120° angular spacing, the spherical holder elements 8 being adapted to move therein between clamping and release positions thereof, respectively protruding and not protruding from the outer surface of a spindle wall 3.

The cylindrical cavity 4 is provided with a piston type pusher 9 adapted to be movable between clamping and release positions thereof. These positions for the pusher 9 are axially spaced from each other. The pusher 9 has its distal end formed with a thrust face 9*a,* 9*b* at an acute angle relative to the longitudinal axis A of the spindle 1. In the illustrated case, the thrust face consists of a thrust face section 9*a,* which has a smaller angle and bears against the holder element 8 in a clamping position of the latter, and a thrust face section 9*b,* which has a larger angle and a function to reduce a displacement required for the pusher 9 between the clamping and release positions. The low-gradient ramp angle of the thrust face 9*a* provides for a sufficient retaining force for holding the ball 8 in its protrusive clamping position.

The force of a spring 10 urges the pusher 9 from its release position to the depicted clamping position, the thrust face 9*a,* 9*b* of the pusher 9 using the force of the spring 10 to shift the holder element 8 from its release position to its clamping position. In the present case, the spring 10 comprises a compression spring, having a section of its length fitted in a cylindrical space formed within the pusher 9.

The pusher 9 is associated with a plunger 11, whereby the pusher 9 is movable against the force of the spring 10 from its clamping position to its release position, the holder elements 8 being thus able to shift from the clamping position to the release position thereof. The plunger 11 comprises a push rod, extending from the cylindrical cavity 4 and having its end provided with an extension 11*a* which has a diameter smaller than the inner diameter of the bearing 6. This is necessary in order to fit the extension 11*a* through the central opening of the bearing 6 for replacing the roller 7. In the process of replacing a roller, its dismounting is effected simply by pressing the plunger 11 inwards with the palm, while gripping the groove 13 of the roller 7 with fingers for pulling the roller out of its position. Respectively, in the process of introducing a roller 7 onto a spindle, the plunger 11 is pushed inwards while pushing the roller 7 to its position. The spindle 1 has its end provided with a reduced diameter spindle extension 3*a* for bringing the bearing 6 smoothly around the spindle 1. Since there is a clearance fit between the inner diameter of the bearing 6 and the reduced-width spindle extension 3*a,* the roller 7 can be readily pushed along the length of the spindle extension 3. As progressive pushing is continued around the wall section 3 of the spindle 1, the reduced-width spindle extension 3*a* provides directional guidance for the roller 7 and thus facilitates mounting of the roller 7 around the cylindrical section 3 of the spindle 1 behind the holder elements 8 until one of the ends of the inner track of the bearing 6 responds to a collar present in the spindle 1.

In the illustrated case, the spindle 1 has a fastening head which comprises a screw tap 2 secured in a tapped hole in a mounting 12. The mounting 12 is a part of the straightening or calibrating mechanism. The fastening tap 2 may comprise e.g. a quadratic spindle, having its end provided with a flange, whereby the spindle can be inserted in an elongated recess formed in a plate functioning as the mounting 12 for bringing the flange to engage behind the plate.

In the process of assembling a mechanism of the invention, the holder elements 8 can be installed in position simply in such a way that, with the pusher 9 in a release position, the holder element 8 is dropped from outside into an opening present in the wall 3 and then the outer edges of the opening are clenched such that the holder element 8 can no longer squeeze out of the opening. The degree of clenching can be adjusted for selecting a maximal protrusion for the holder elements 8, which is slightly more prominent than that shown in the illustrated clamping position. The plunger 11 can be secured e.g. with a screw tap element present in its end into a tapped hole present in the distal end of the pusher 9.

Figure 2:
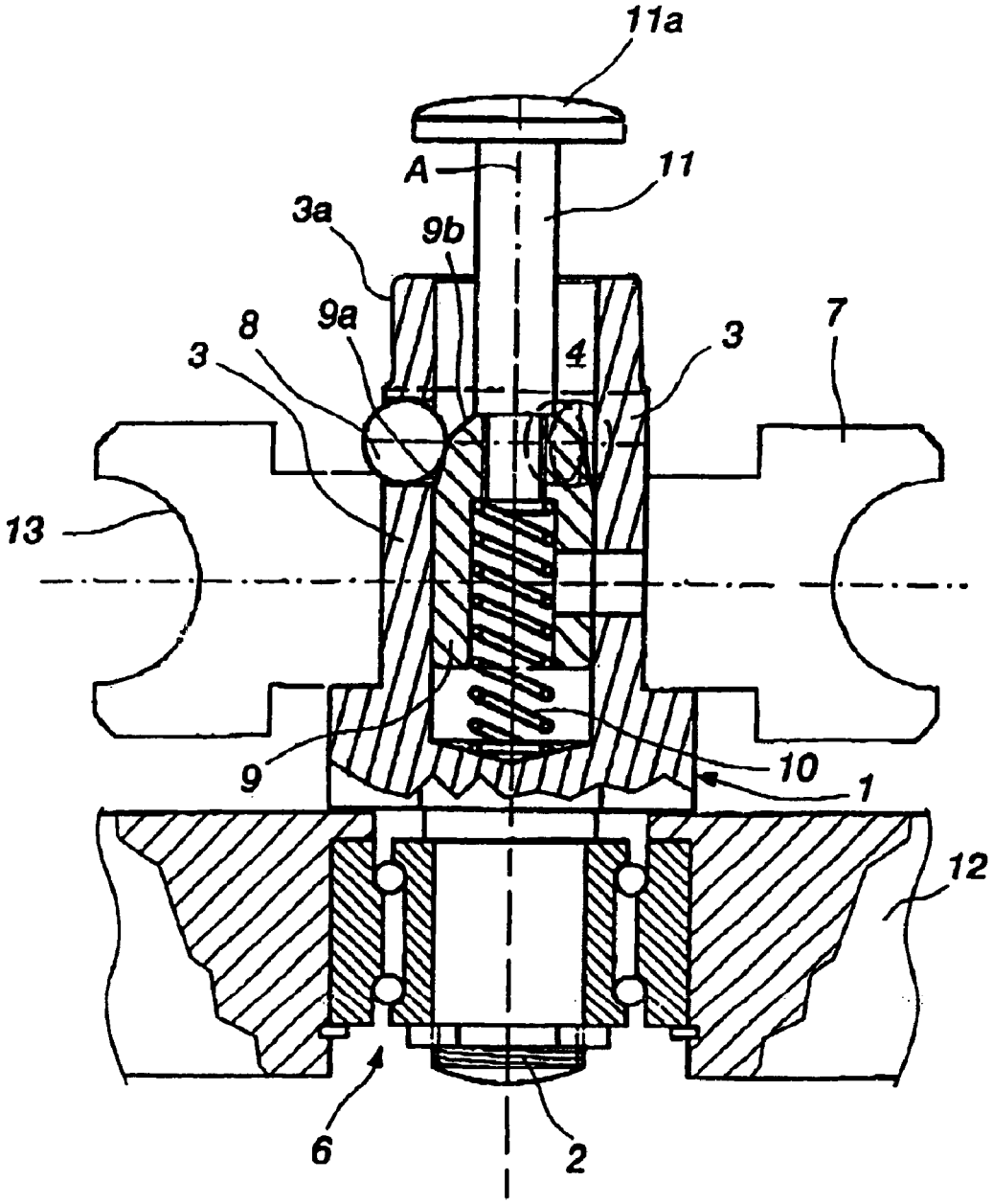
FIG. 2 shows the same mechanism in a second application, wherein the roller has its inner track mounted on a rotatably pivoted spindle.

The exemplary embodiment of FIG. 2 is only different from FIG. 1 in the sense that the spindle 1 is rotatably pivoted to its mounting 12 by means of the bearing 6. Thus, the roller 7 is not provided with a bearing but, instead, it is mounted with its inner track around the rotating spindle 1. In this embodiment, the shaft 3 may also have a cross-sectional shape other than circular. The advantage offered by this embodiment is that the number of required bearings 6 will be fewer, since the number of rollers 7 to be replaced in the straightening or calibrating mechanism will be higher than the number of spindles 1. Another advantage is that mounting of the roller 7 on the spindle 1 is not dependent on the dimensions of an employed bearing. This applies both to radial and axial dimensioning. This facilitates particularly the use of rollers provided with multiple circular grooves, whereby, after turning the rollers, the various circular grooves can be brought to coincide with the same pipe or shaft drawing line. With bearing-fitted rollers the availability of this possibility is highly limited.

The invention is not limited to the foregoing exemplary embodiment. For example, the balls 8 can be cylindrical or conical in shape, nor is the motion of the pusher 9 restricted to an axial movement as it can also perform a circular motion or a combination of axial and circular motion. The spring 10 may also find several variations regarding its location and configuration. Instead of a mechanical spring it is viable to use e.g. a pneumatic or hydraulic power unit, wherein a pressure medium is adapted to be supplied along a passage extending from the mounting 12 through the spindle 1 into the cylindrical cavity 4 behind the piston type pusher 9. In a preferred embodiment of the invention, no components of the clamping mechanism are removed from the spindle or the mechanism for the duration of a replacement process. However, it is possible that the connection of the plunger 11 with the end of the pusher 9 is implemented by some other means than a permanently intended threaded joint, e g. by means of a bayonet type quick release coupling or just a pin/socket fitting, whereby one and the same plunger can be used for a variety of spindles. What is essential is that the clamping be implemented by means of a spring or some other power unit and the clamping be released manually for accomplishing the object of the invention.

What is claimed is:

1. A mounting and dismounting mechanism for a straightening or calibrating roller having a circular groove, the mechanism comprising a spindle, the spindle having a largest diameter portion, a large diameter portion, a reduced diameter spindle extension and a collar formed between the largest diameter portion and the large diameter portion, the roller being adapted to be mountable and clampable around the spindle to abut against said collar, and to be dismountable and removable from around the spindle co-directionally with a longitudinal axis (A) of the spindle and, the reduced diameter spindle extension providing the roller a preliminary alignment and for guiding the roller smoothly around the spindle, the spindle having a wall with an outer surface and a cylindrical cavity, the wall provided with at least one opening, at least one holder element being adapted to move within the cylindrical cavity between clamping and release positions thereof, respectively protruding through the at least one opening to protrude from the outer surface of the spindle to retain a roller to the spindle and not protruding from the outer surface of the spindle, a pusher adapted to be movably located within the cylindrical cavity and being movable between clamping and release positions thereof, the pusher being formed with a thrust face to engage the holder element, and a biasing means biasing the pusher to shift from its release position to its clamping position whereby the thrust face of the pusher moves the at least one holder element from its release position to its clamping position protruding from the outer surface of the spindle to retain a roller to the spindle, and a plunger affixed to the pusher, whereby the pusher is movable against the force of the biasing means from its clamping position to its release position, the at least one holder element being thus capable of shifting from its clamping position to its release position wherein the roller can be removed from said mechanism without removing any components from said mechanism.

2. A mechanism as set forth in claim 1 wherein the pusher has its clamping position and release position axially spaced from each other, and the thrust face is at an acute angle relative to the longitudinal axis of the spindle.

3. A mechanism as set forth in claim 2 wherein the acute angle between the thrust face and the longitudinal axis (A) increases towards the distal end of the pusher, and the thrust face section has a smaller angle and bears against the at least one holder element in the clamping position of the at least one holder element.

4. A mechanism as set forth in claim 1 wherein the spindle comprises a stationary spindle and the roller is provided with a bearing having an inner diameter.

5. A mechanism as set forth in claim 4 wherein the plunger comprises a push rod, extending from the cavity and having its end provided with an extension having a diameter which is smaller that the inner diameter of the bearing.

6. A mechanism as set forth in claim 1 wherein the spindle comprises a rotatably pivoted spindle.

7. A mechanism as set forth in claim 1 wherein the at least one holder element comprises a ball.

8. A mechanism as set forth in claim 1 wherein the at least one holder element comprises three holder elements and the at least one opening in the wall of the cavity comprises three openings spaced from each other by an angular distance.

9. A mechanism as set forth in claim 1 wherein the biasing means comprises a mechanical spring, a section of its length being fitted in a cavity established within the pusher.

10. A mechanism as set forth in claim 1 wherein the cavity is cylindrical and the pusher comprises a cylindrical piston element.

* * * * *